US007107905B2

(12) United States Patent
Mori

(10) Patent No.: US 7,107,905 B2
(45) Date of Patent: Sep. 19, 2006

(54) PRINTING PLATE MATERIAL AND PRINTING PROCESS

(75) Inventor: Takahiro Mori, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 10/938,889

(22) Filed: Sep. 13, 2004

(65) Prior Publication Data

US 2005/0056179 A1 Mar. 17, 2005

(30) Foreign Application Priority Data

Sep. 17, 2003 (JP) ..... 2003-324234

(51) Int. Cl.
*B41N 1/00* (2006.01)

(52) U.S. Cl. ..... 101/453; 101/457; 101/462; 430/302; 430/270.1

(58) Field of Classification Search ..... 101/453, 101/454, 457, 460, 462; 430/302, 270.1–273
See application file for complete search history.

(56) References Cited

U.S. PATENT DOCUMENTS 5,249,525 A * 10/1993 Lewis et al. ..... 101/453
6,230,621 B1 * 5/2001 Verschueren et al. ..... 101/453
6,245,477 B1 * 6/2001 Ray et al. ..... 430/138
6,399,270 B1 * 6/2002 Mori et al. ..... 430/270.1
6,513,433 B1 * 2/2003 Inoue et al. ..... 101/457
2001/0036592 A1 * 11/2001 Hoshi et al. ..... 430/270.1
2002/0172891 A1 * 11/2002 Mori ..... 430/302
2003/0129520 A1 * 7/2003 Oohashi et al. ..... 430/138
2003/0143471 A1 * 7/2003 Mitsuhashi et al. ..... 430/5
2003/0148218 A1 * 8/2003 Mori ..... 430/273.1

FOREIGN PATENT DOCUMENTS

EP 1 266 751 12/2002
EP 1 334 842 8/2003
EP 1 470 916 10/2004

* cited by examiner

*Primary Examiner*—Daniel J. Colilia
*Assistant Examiner*—Jill E. Culler
(74) *Attorney, Agent, or Firm*—Finnegan, Henderson, Farabow, Garrett & Dunner, L.L.P.

(57) ABSTRACT

Disclosed is a printing plate material comprising a support and provided thereon, a hydrophilic layer containing pigment particles having a light-to-heat conversion capability, wherein the pigment particles have an average particle diameter of from 0.15 μm to less than 1.0 μm, and the hydrophilic layer has a surface roughness Ra of from 0.2 μm to less than 1.5 μm.

12 Claims, No Drawings

PRINTING PLATE MATERIAL AND PRINTING PROCESS

FIELD OF THE INVENTION

The present invention relates to a printing plate material and a printing process, and particularly to a printing plate material capable of forming an image by a computer to plate (CTP) system and a printing process employing the same.

BACKGROUND OF THE INVENTION

The planographic printing plate material for CTP, which is inexpensive, can be easily handled, and has a printing ability comparable with that of a PS plate, is required accompanied with the digitization of printing data. Recently, a CTP system (hereinafter also referred to as thermal CTP) according to various systems employing infrared laser has been proposed.

As one embodiment of the thermal CTP, there is a process (so-called wet type thermal CTP) in which a printing plate material is developed with a liquid developer to form an image where solubility to the developer of the image formation layer of the printing plate material is varied by exposure. However, this process has problems in that an exclusive alkali developer for development is required like a conventional PS plate, developability varies due to the state (temperature or degree of fatigue) of the developer, which results in poor image reproducibility, or there are limitations to handling under room light.

A thermal processless CTP (including one capable of being developed on a press) has been developed which does not require specific development. The thermal processless CTP has been noted, since it can be applied to a printing press employing a direct imaging (DI) process in which an image is directly written on the press, followed by printing.

As one embodiment of the thermal processless CTP, there is a CTP of the ablation type. Examples of the CTP of the ablation type include those disclosed in for example, Japanese Patent O.P.I. Publication Nos. 8-507727, 6-186750, 6-199064, 7-314934, 10-58636 and 10-244773.

These references disclose a printing plate material comprising a support, and provided thereon, a hydrophilic layer and a lipophilic layer, either of which is an outermost layer. When a printing plate material is imagewise exposed in which the hydrophilic layer is an outermost layer and the lipophilic layer containing a light-to-heat conversion material is under the hydrophilic layer, the hydrophilic layer is imagewise ablated by heat generated in the lipophilic layer and removed to reveal the lipophilic layer, whereby an image is formed.

A printing plate material has been developed which is capable of forming an image without ablation, and does not require development treatment employing a special developer or wiping-off treatment. There is, for example, a CTP as disclosed in Japanese Publication Nos. 2938397 and 2938397, which comprises an image formation layer containing thermoplastic particles and a water-soluble binder and which is capable of be developed with a dampening solution on a printing press (on-press development). The CTP of this type, when a grained aluminum plate is used as a hydrophilic support, needs to incorporate a light-to-heat conversion material (generally colored) in the image formation layer and has problem of contaminating a printing press during on-press-development. Further, the CTP of this type needs to increase an amount of a light-to-heat conversion material in the image formation layer for high sensitization, which is sought as a processless CTP, but the increase is more likely to contaminate a printing press.

As a method for preventing the contamination of a printing press which is caused during on-press development, a method has been proposed which employs, as a hydrophilic support, a support in which a hydrophilic layer containing a light-to-heat conversion material is provided on a substrate. Such a hydrophilic layer makes it possible to eliminate the light-to-heat conversion material from the image formation layer. Further, this method can achieve high sensitization without contaminating a printing press, since it can increase the amount of the light-to-heat conversion material in the hydrophilic layer or incorporate a slight amount of the light-to-heat conversion material in the image formation layer.

However, a material for forming an irregularity structure on the surface of the hydrophilic layer is generally contained in the hydrophilic layer besides the light-to-heat conversion material in order to improve a printing property or an image retention property. For example, the present inventor discloses, in Japanese Patent O.P.I. Publication No. 2000-225780, a hydrophilic layer containing porous inorganic fillers with a particle diameter not more than 1.0 μm for improving a printing property or an image retention property besides the light-to-heat conversion material. Further, the present inventor discloses, in Japanese Patent O.P.I. Publication No. 2002-370465, a hydrophilic layer containing plural irregularity structure-forming inorganic fillers and an inorganic binder with high porosity as well as the light-to-heat conversion material in order to improve a printing property or an image retention property.

The hydrophilic layer described above has a good printing property and good image retention property, however, the hydrophilic layer has also problem in that the layer strength is relatively low, since materials constituting the hydrophilic layer are highly porous. When the amount of the light-to-heat conversion material in the hydrophilic layer is increased in order to increase sensitivity, it is necessary to decrease material as a binder by increment of the light-to-heat conversion material, which further lowers the layer strength. This lowers abrasion resistance of the hydrophilic layer during printing, and greatly lowers printing durability, particularly when printing conditions vary during printing, for example, printing pressure or ink roller pressure increases.

As the countermeasure, there is a method which decreases the inorganic fillers etc., by the increment of the light-to-heat conversion material, however, this method has problem in that a printing property and an image retention property deteriorate.

It has been considered that in a printing plate material comprising a hydrophilic layer containing a light-to-heat conversion material, it is extremely difficult to increase sensitivity or to improve or maintain printing properties or printing durability.

SUMMARY OF THE INVENTION

An object of the invention is to provide a printing plate material providing high sensitivity, good printing properties and high printing durability, and to provide a printing process employing the printing plate material which provides good printing environment.

DETAILED DESCRIPTION OF THE INVENTION

The above object of the invention can be attained by the following constitutions.

1. A printing plate material comprising a support and provided thereon, a hydrophilic layer containing pigment particles having a light-to-heat conversion capability, wherein the pigment particles have an average particle diameter of from 0.15 μm to less than 1.0 μm, and the hydrophilic layer has a surface roughness Ra of from 0.2 μm to less than 1.5 μm.

2. The printing plate material of item 1 above, wherein the content of the pigment particles in the hydrophilic layer is from 0.5 $g/m^2$ to less than 5 $g/m^2$.

3. The printing plate material of item 1 above, wherein the pigment particles are black iron oxide particles.

4. The printing plate material of item 3 above, wherein the black iron oxide particles are spherical or octahedral.

5. The printing plate material of item 1 above, wherein an image formation layer, containing a hydrophobe precursor, is provided on the hydrophilic layer.

6. The printing plate material of item 5 above, wherein the hydrophobe precursor is thermoplastic hydrophobic particles or microcapsules encapsulating a hydrophobic compound.

7. The printing plate material of item 6 above, wherein the hydrophobe precursor is thermoplastic hydrophobic particles.

8. The printing plate material of item 7 above, wherein the thermoplastic hydrophobic particles are particles formed from wax selected from the group consisting of paraffin wax, polyolefin wax, microcrystalline wax, fatty acid esters, and higher fatty acids.

9. The printing plate material of item 5 above, wherein the image formation layer further contains a salt of polyacrylic acid.

10. The printing plate material of item 5 above, wherein the image formation layer contains an infrared absorbing dye.

11. A printing process comprising the step of:

imagewise exposing the printing plate material of any one of item 1 through 10 above; and supplying a dampening solution containing alcohol in an amount of not more than 5% by weight to the resulting printing plate material.

12. The printing process of item 11 above, wherein the imagewise exposing is carried out employing an infrared laser.

13. The printing process of item 11 above, wherein the dampening solution does not substantially contain alcohols.

14. The printing process of item 11 above, wherein the imagewise exposing is carried out on a printing press.

1-1. A printing plate material comprising a support and provided thereon, a hydrophilic layer containing pigment particles having a light-to-heat conversion capability, wherein the hydrophilic layer has a surface roughness Ra of from 0.2 μm to less than 1.5 μm, and the pigment particles have an average particle diameter of from 0.15 μm to less than 1.0 μm.

1-2. The printing plate material of item 1-1 above, wherein the content of the pigment particles in the hydrophilic layer is from 0.5 $g/m^2$ to less than 5 $g/m^2$.

1-3. The printing plate material of item 1-1 or 1-2 above, wherein the pigment particles are black iron oxide particles.

1-4. The printing plate material of item 1-3 above, wherein the black iron oxide particles are spherical or octahedral.

1-5. The printing plate material of any one of items 1-1 through 1-4 above, wherein an image formation layer, which is capable of forming an image by heating, is provided on the hydrophilic layer.

1-6. The printing plate material of item 1-5 above, wherein the image formation layer contains a hydrophobe precursor.

1-7. The printing plate material of item 1-6 above, wherein the hydrophobe precursor is thermoplastic hydrophobic particles or microcapsules encapsulating a hydrophobic compound.

1-8. The printing plate material of any one of items 1-5 through 1-7 above, wherein the image formation layer contains a salt of polyacrylic acid.

1-9. The printing plate material of any one of items 1-5 through 1-8 above, wherein the image formation layer contains an infrared absorbing dye.

1-10. A printing process comprising the step of forming an image on the printing plate material of any one of items 1-1 through 1-9 above; and supplying a dampening solution containing alcohol in an amount of not more than 5% by weight to the resulting printing plate material.

1-11. The printing process of item 1-10 above, wherein the dampening solution does not substantially contain alcohols.

1-12. The printing process of item 1-10 or 1-11 above, wherein the image forming is carried out on a printing press.

The present inventor has made an extensive study, and as a result, he has found that a printing plate material provides high sensitivity, good printing properties and high printing durability, which comprises a support and provided thereon, a hydrophilic layer containing pigment particles having a light-to-heat conversion capability, wherein the hydrophilic layer has a surface roughness Ra of from 0.2 μm to less 1.5 μm, and the pigment particles have an average particle diameter of from 0.15 μm to less than 1.0 μm.

Preferred embodiment is a printing plate material in which in the printing plate material above, the content of the pigment particles in the hydrophilic layer is from 0.5 $g/m^2$ to less than 5 $g/m^2$, the pigment particles are black iron oxide particles, the black iron oxide particles are spherical or octahedral, an image formation layer, which is capable of forming an image due to heat, is provided on the hydrophilic layer, the image formation layer contains a hydrophobe precursor, the hydrophobe precursor is thermoplastic hydrophobic particles or microcapsules encapsulating a hydrophobic compound, the image formation layer contains a salt of polyacrylic acid, or the image formation layer contains an infrared absorbing dye.

It has been also found that a printing process provides good printing environment, which comprises the step of forming an image on the printing plate material described above, and supplying a dampening solution containing alcohol in an amount of not more than 5% by weight to the resulting printing plate material. A printing process, wherein in the printing process above, the dampening solution contains no alcohols or the image forming is carried out on a printing press, is more preferred.

The present invention will be-explained in detail below.

The printing plate material of item 1 above is characterized in that the material comprises a support and provided thereon, a hydrophilic layer containing pigment particles having a light-to-heat conversion capability, wherein the hydrophilic layer has a surface roughness Ra of from 0.2 μm to less than 1.5 μm, and the pigment particles have an average particle diameter of from 0.15 μm to less than 1.0 μm.

The pigment particles having an average particle diameter of from 0.15 μm to less than 1.0 μm can have a function as a light-to-heat conversion material and a function forming a sub-micron irregularity structure (which can improve a printing property or an image retention property). The pigment particles can make it possible to eliminate, from a hydrophilic layer, inorganic fillers with a particle diameter of a submicron order and without light-to-heat conversion capability, which have been used in the hydrophilic layer for forming a submicron order irregularity structure, and to solve the problem that increase of the pigment particle content in the hydrophilic layer for improving sensitivity lowers the layer strength. The pigment particles with an average particle diameter of less than 0.15 μm form insufficient irregularity structure, resulting in lowering a printing property or an image retention property, while the pigment particles with an average particle diameter of not less than 1.0 μm lower light-to-heat conversion efficiency for the content, which is not practicable. The average particle diameter of the pigment particles is preferably from 0.15 μm to 0.5 μm, and more preferably from 0.15 μm to 0.3 μm. Herein, the average particle diameter in the invention refers to an average particle diameter of pigment particles which are dispersed in the particle form in the hydrophilic layer, but not an average primary order particle diameter of pigment particles.

The average particle diameter of the pigment particles is measured by the following method. The particle diameter of the pigment particles is observed by means of a scanning electron microscope S-800 (produced by HITACHI SEISAKUSHO Co., Ltd.), and measured at a magnification of 20,000. The particle diameters of one hundred particles are measured and the average is calculated and defined as the average particle diameter in the invention. Herein, the particle diameter of the pigment particles is defined as a diameter of the largest circle circumscribing projected image of the pigment particle.

The surface roughness Ra of the hydrophilic layer is preferably from 0.2 to less 1.5 μm. The surface roughness Ra of the hydrophilic layer falling within the above range provides the same water tolerance during printing as a conventional grained aluminum plate. Such a surface roughness Ra of the hydrophilic layer can be obtained by adding fillers with an average particle diameter to a hydrophilic layer; by forming a hydrophilic layer on a surface roughened substrate; or by forming an under layer with a roughened surface on a substrate and forming a hydrophilic layer on the under layer. The surface roughness Ra of the hydrophilic layer less than 0.2 μm provides poor water retention, resulting in stain occurrence at non-image portions, while the surface roughness Ra of the hydrophilic layer not less than 1.5 μm has problems in that on-press developability of the image formation layer described later or reproducibility of a line image is lowered.

(Support)

As the support in the invention, those well known in the art as supports for printing plates can be used. Examples of the support include a metal plate, a plastic film sheet, a paper sheet treated with polyolefin, and composite materials such as laminates thereof. The thickness of the support is not specifically limited as long as a printing plate having the support can be mounted on a printing press, and is advantageously from 50 to 500 μm in easily handling.

Examples of the metal plate include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool. The degreasing is carried out preferably employing an aqueous alkali solution. In order to increase adhesion between the support and a coating layer, it is preferred that the surface of the support is subjected to adhesion increasing treatment or is coated with a subbing layer. For example, the support is immersed in a solution containing silicate or a coupling agent such as a silane coupling agent, or the support is coated with the solution and then sufficiently dried. Anodization treatment is considered to be one kind of adhesion increasing treatment, and can be used. The anodization treatment and the immersing or coating treatment described above can be used in combination. Aluminum plate (so-called grained aluminum plate), which has been surface-roughened with a conventional method, can be used as a support having a hydrophilic surface.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film.

The plastic film is preferably a polyethylene terephthalate film, or a polyethylene naphthalate film. In order to increase adhesion between the support and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. Examples of the subbing layer include a layer containing gelatin or latex. The subbing layer can contain known organic or inorganic electrically conductive material.

A support can be preferably used which is provided with a known back coat layer for the purpose of controlling slipping property of the back coat layer (for example, reducing a coefficient of friction between the back coat layer and the surface of the plate cylinder of a press) or controlling the electroconductivity.

(Hydrophilic Layer)

Material used in the hydrophilic layer is preferably a metal oxide. The metal oxide is preferably metal oxide particles. Examples of the metal oxide particles include colloidal silica particles, an alumina sol, a titania sol and another metal oxide sol. The metal oxide particles may have any shape such as spherical, needle-like, and feather-like shape. The average particle diameter is preferably from 3 to 100 nm, and plural kinds of metal oxide each having a different diameter may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength. It is known that the binding force of the colloidal silica particles is become larger with decrease of the particle diameter. The average particle diameter of the colloidal silica particles to be used in the invention is preferably not more than 20 nm, and more preferably 3 to 15 nm. Alkaline colloidal silica particles of colloidal silica particles show the effect of inhibiting occurrence of the background contamination. Accordingly, the use of the alkaline colloidal silica particles is particularly preferable. Examples of the alkaline colloidal silica particles having the average particle diameter within the foregoing range include Snowtex-20 (average particle diameter: 10 to 20 nm), Snowtex-30 (average particle diameter: 10 to 20 nm), Snowtex-40 (average particle diameter: 10 to 20 nm), Snowtex-N (average particle diameter: 10 to 20 nm), Snowtex-S (average particle diameter: 8 to 11 nm) and Snowtex-XS (average particle diameter: 4 to 6 nm), each produced by Nissan Kagaku Co., Ltd.

The hydrophilic layer in the invention can contain necklace-shaped colloidal silica as a porosity providing material. The necklace-shaped colloidal silica to be used in the invention is a generic term of an aqueous dispersion system of spherical silica having a primary particle diameter of the order of nm. The necklace-shaped colloidal silica to be used in the invention means a "pearl necklace-shaped" colloidal silica formed by connecting spherical colloidal silica particles each having a primary particle diameter of from 10 to 50 μm so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd. As the products, there are Snowtex-PS-S (the average particle diameter in the connected state is approximately 110 nm), Snowtex-PS-M (the average particle diameter in the connected state is approximately 120 nm) and Snowtex-PS-L (the average particle diameter in the connected state is approximately 170 nm). Acidic colloidal silicas corresponding to each of the above-mentioned are Snowtex-PS-S-O, Snowtex-PS-M-O and Snowtex-PS-L-O, respectively. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

The hydrophilic layer in the invention can contain porous metal oxide particles as another prosity providing material. Examples of the porous metal oxide particles include porous silica particles, porous aluminosilicate particles or zeolite particles as described later.

(Porous Silica Particles, Porous Aluminosilicate Particles)

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle diameter of such particles can be controlled by variation of the production conditions. The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle diameter can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume before the dispersion. The pore volume is closely related to water retention of the coated layer. As the pore volume increases, the water retention is increased, stain is difficult to occur, and water tolerance is high. Particles having a pore volume of more than 2.5 ml/g are brittle, resulting in lowering of durability of the layer containing them. Particles having a pore volume of less than 1.0 ml/g results in lowering of anti-stain property or water tolerance in printing.

The particle diameter of the particles dispersed in the hydrophilic layer (or in the dispersed state before formed as a layer) is preferably not more than 1 μm, and more preferably not more than 0.5 μm. Presence in the hydrophilic layer of particles with an extremely large diameter forms porous and sharp protrusions on the hydrophilic layer surface, and ink is likely to remain around the protrusions, which may produce stain at non-image portions of the printing plate and on the blanket of a press during printing.

(Zeolite Particles)

Zeolite is a crystalline aluminosilicate, which is a porous material having voids of a regular three dimensional net work structure and having a pore size of 0.3 to 1 nm. Natural and synthetic zeolites are expressed by the following formula.

$$(M^1,(M^2)_{1/2})_m(Al_mSi_nO_{2(m+n)}).xH_2O$$

In the above, $M^1$ and $M^2$ are each exchangeable cations. Examples of $M^1$ include $Li^+$, $Na^+$, $K^+$, $Tl^+$, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2^{2+}$. Relation of n and m is $n \geqq m$, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}(Al_{12}Si_{12}O_{48}).27H_2O$; Al/Si=1.0, Zeolite X: $Na_{86}(Al_{86}Si_{106}O_{384}).264H_2O$; Al/Si=0.811, and Zeolite Y: $Na_{56}(Al_{56}Si_{136}O_{384}).250H_2O$; Al/Si=0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The size of the porous inorganic particles in the hydrophilic layer is preferably not more than 1 μm, and more preferably not more than 0.5 μm.

The hydrophilic layer in the invention can contain, as an irregularity-forming material, inorganic particles with a particle diameter of not less than 1 μm or inorganic material coated particles. Examples of the inorganic particles include particles of known metal oxides such silica, alumina, titania and zirconia. However, porous metal oxide particles are preferably used in order to prevent sedimentation of the particles in the coating solution.

The porous particles as described above such as porous silica particles, porous aluminosilicate particles or zeolite particles can be preferably used as the irregularity-forming material.

As the inorganic material coated particles, there are, for example, particles in which organic particles such as particles of PMMA or polystyrene as core particles are coated with inorganic particles with a particle diameter smaller that that of the core particles. The particle diameter of the inorganic particles is preferably from 1/10 to 1/100 of that of the core particles. As the inorganic particles, particles of known metal oxides such silica, alumina, titania and zirconia can be used. The porous particles as described above such as porous silica particles, porous aluminosilicate particles or zeolite particles can be preferably used as the irregularity-forming material.

Various coating methods can be used, but a dry process is preferred which core particles collide with particles for coating at high speed in air as in a hybridizer to push the particles for coating in the core particle surface and fix, whereby the core particles are coated with the particles for coating.

Particles, in which the organic core particles are plated with metal, can be used. As such particles, there is, for example, "Micropearl AU", produced by SEKISUI KAGAKU KOGYO Co, Ltd., in which resin particles are plated with gold.

The hydrophilic layer in the invention can contain, as an irregularity-forming material, hydrophilic organic particles with a particle diameter of not less than 1 μm. Examples of the hydrophilic organic particles include calcium alginate particles and chitosan particles. The chitosan particles are preferably used, since they improve dispersion stability of pigment particles and coatability of the hydrophilic layer. The particle diameter of the irregularity-forming material is preferably from 1 to 10 μm, more preferably from 1.5 to 8 μm, and still more preferably from 2 to 6 μm. The particles diameter exceeding 10 μm results in problem of lowering dissolution of formed images or contaminating a blanket.

The hydrophilic layer of the printing plate material in the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle diameter, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

The planar structural mineral particles are preferably in the plate form, and have an average particle diameter (an average of the largest particle length) of preferably not more than 20 μm, and an average aspect ratio (the largest particle length/the particle thickness) of preferably not less than 20, and more preferably not less than 50, in a state contained in the layer including the case that the particles are subjected to a swelling process and a dispersing layer-separation process. The particles more preferably have an average particle diameter of preferably not more than 5 μm, and an average aspect ratio of not less than 50, and still more preferably have an average particle diameter of preferably not more than 1 μm, and an average aspect ratio of not less than 50. When the particle diameter is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle diameter falling outside the above range may lower scratch resistance. The aspect ratio lower than the foregoing provides poor flexibility, and may lower scratch resistance.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase in the invention. An alkali metal silicate such as sodium silicate, potassium silicate or lithium silicate is preferable, and the $SiO_2/M_2O$ is preferably selected so that the pH value of the coating liquid after addition of the silicate does not exceed 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

In the invention, the hydrophilic layer may contain a water soluble resin or a water dispersible resin. Examples thereof include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

Item 2 above is characterized in that in the printing plate material of the invention, the content of the pigment particles in the hydrophilic layer is from 0.5 $g/m^2$ to less than 5 $g/m^2$. The pigment particle content less than 0.5 $g/m^2$ is lower than practical speed, and while the pigment particle content not less than 5 $g/m^2$ only saturates light-to-heat conversion function, and does not show effects due to the increase in quantity.

The pigment particle content of the hydrophilic layer is preferably from 10% by weight to less than 80% by weight, and more preferably from 30% by weight to less than 60% by weight. The pigment particle content less than 10% by weight is lower than practical speed, and while the pigment particle content not less than 80% by weight results in problem of lowering strength of the hydrophilic layer.

Item 3 above is characterized in that in the printing plate material of the invention, the pigment particles are black iron oxide particles. Examples of the pigment particles include metal particles and metal oxide particles. Among these, metal oxide particles are preferred, as materials having high hydrophilicity which do not lower hydrophilicity of a hydrophilic layer. Among metal oxide particles, particles of black-colored titanium black, black complex metal oxides, black iron oxide (Fe3O4) have good light-to-heat conversion effect, and are preferably used.

Examples of the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion.

In the invention, black iron oxide particles are preferably used as pigment particles. The black iron oxide particles have an acicular ratio (major axis length/minor axis length) of preferably from 1 to 1.5. It is preferred that the black iron oxide particles are substantially spherical ones (having an acicular ratio of 1) or octahedral ones (having an acicular ratio of 1.4).

Examples of the black iron oxide particles include for example, TAROX series produced by Titan Kogyo K.K. Examples of the spherical particles include BL-100 (having an average particle diameter of from 0.2 to 0.6 μm, and BL-500 (having an average particle diameter of from 0.3 to 1.0 μm. Examples of the octahedral particles include ABL-203 (having an average particle diameter of from 0.4 to 0.5 μm, ABL-204 (having an average particle diameter of from 0.3 to 0.4 μm, ABL-205 (having an average particle diameter of from 0.2 to 0.3 μm, and ABL-207 (having an average particle diameter of 0.2 μm.

The black iron oxide particles may be surface-coated with inorganic compounds such as $SiO_2$. Examples of such black iron oxide particles include spherical particles BL-200 (having an average particle diameter of from 0.2 to 0.3 μm) and octahedral particles ABL-207A (having an average particle diameter of 0.2 μm), each having been surface-coated with $SiO_2$.

These black iron oxide particles are easily dispersed in water, and have characteristics in that they are poured as powder in water and stirred to obtain a dispersion in which the particles are uniformly dispersed. In the process in which a hydrophilic layer containing black iron oxide particles is coated on a support and dried, the black iron oxide particles are linked with one another to form a high order structure and form a roughness with a waviness of from several to scores microns, whereby a multi-roughness surface, in which submicron irregularities are superposed, is formed on the hydrophilic layer. The mechanism of such a surface formation is not clear, but is considered to be due to slight magnetism which the particles themselves have. The multi-roughness surface provides printing properties equal to those of a grained aluminum plate and greatly improves an image retention property.

As one embodiment of the invention, there is a printing plate material comprising a hydrophilic layer and provided thereon, an image formation layer on which an image is formed by heating.

(Image Formation Layer)

The image formation layer in the invention can form an image on it by heating. The image formation layer is preferably one on which an image is to be formed by heat generated on infrared ray exposure.

With respect to exposure, scanning exposure is preferred which is carried out employing an infrared or near-infrared laser which emits light having a wavelength of from 700 to 1500 nm. As the laser, a gas laser can be used, but a semiconductor laser, which emits near-infrared light, is preferably used.

The scanning exposure device used in the invention may be any as long as it can form an image on the surface of a printing plate material employing the semiconductor laser, based on image formation from a computer.

One preferred embodiment of the image formation layer in the invention contains a hydrophobe precursor. As the hydrophobe precursor can be used a polymer whose property is capable of changing from a hydrophilic property (a water dissolving property or a water swelling property) or to a hydrophobic property by heating. Examples of the hydrophobe precursor include a polymer having an aryldiazosulfonate unit as disclosed in for example, Japanese Patent O.P.I. Publication No. 200-56449. In the invention, the hydrophobe precursor is preferably thermoplastic hydrophobic particles or microcapsules encapsulating a hydrophobic compound.

As the thermoplastic hydrophobic particles, there are heat melting particles or heat fusible particles, as described later. The heat melting particles used in the invention are particularly particles having a low melt viscosity, which are particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include waxes such as paraffin wax, polyolefin wax (for example, polyethylene wax), and microcrystalline wax; fatty acid ester; and higher fatty acid. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene wax, microcrystalline wax, fatty acid ester and higher fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to stain which may be caused by scratch is further enhanced.

The heat melting particles are preferably dispersible in water. The average particle diameter thereof is preferably from 0.01 to 10 μm, and more preferably from 0.1 to 3 μm. When a layer containing the heat melting particles is coated on the porous hydrophilic layer, the particles having an average particle diameter less than 0.01 μm may enter the pores of the hydrophilic layer or the valleys between the neighboring two peaks on the hydrophilic layer surface, resulting in insufficient development-on-press and in stain occurrence at the background. The particles having an average particle diameter exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight. The heat fusible particles in the invention include thermoplastic hydrophobic polymer particles. Although there is no specific limitation to the upper limit of the softening point of the thermoplastic hydrophobic polymer, the softening point is preferably lower than the decomposition temperature of the polymer. The weight average molecular weight (Mw) of the thermoplastic hydrophobic polymer is preferably within the range of from 10,000 to 1,000,000.

Examples of the polymer consisting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co)polymer or a (meth)acrylic acid (co)polymer such as polymethyl methacrylate, a methyl methacrylate-(2-ethylhexyl)acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle diameter of the heat fusible particles is preferably from 0.01 to 10 μm, and more preferably from 0.1 to 3 μm. When a layer containing the heat fusible particles having an average particle diameter less than 0.01 μm is coated on the porous hydrophilic layer, the particles may enter the pores of the hydrophilic layer or the valleys between the neighboring two peaks on the hydrophilic layer surface, resulting in insufficient development-on-press and in background contamination. The heat fusible particles having an average particle diameter exceeding 10 μm result in lowering of dissolving power.

Further, the composition of the heat fusible particles may be continuously varied from the interior to the surface of the particles. The particles may be covered with a different material. As a covering method, known methods such as a microcapsule method and a sol-gel method are usable. The heat fusible particle content of the layer is preferably from 1 to 90% by weight, and more preferably from 5 to 80% by weight based on the total weight of the layer.

(Microcapsules)

Microcapsules used in the printing plate material in the invention include those encapsulating oleophilic materials disclosed in Japanese Patent O.P.I. Publication Nos. 2002-2135 and 2002-19317.

The average microcapsule diameter of the microcapsules is preferably from 0.1 to 10 μm, more preferably from 0.3 to 5 μm, and still more preferably from 0.5 to 3 μm.

The thickness of the microcapsule wall is preferably from 1/100 to 1/5 of the average microcapsule diameter, and more preferably from 1/50 to 1/10 of the average microcapsule diameter. The microcapsule content of the image formation layer is preferably from 5 to 100% by weight, more preferably from 20 to 95% by weight, and most preferably from 40 to 90% by weight.

As the materials for the microcapsule wall, known materials can be used. As a method of manufacturing the microcapsules, known methods can be used. The materials for the microcapsule wall and the manufacturing method of the microcapsule wall can be applied which are disclosed in for example, Tamotsu Kondo, Masumi Koishi, "New Edition Microcapsule, Its Manufacturing Method, Properties And Application", published by Sankyo Shuppan Co., Ltd., or disclosed in literatures cited in it.

The average particle diameter of the thermoplastic hydrophobic particles or the microcapsules is measured by the same method as described above in the pigment particles.

(Materials which the Image Formation Layer in the Invention May Contain)

The image formation layer in the invention can further contain the following water soluble resins or water dispersible resins.

Water soluble resins or water dispersible resins include oligosaccharides, polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylic acid, polyacrylic acid salts, polyacrylamide, and polyvinyl pyrrolidone. Among these, oligosaccharides, polysaccharides, polyacrylic acid, polyacrylic acid salts or polyacrylamide are preferred.

Examples of the oligosaccharides include raffinose, trehalose, maltose, galactose, sucrose, and lactose. Among these, trehalose is preferred.

Examples of the polysaccharides include starches, celluloses, polyuronic acid and pullulan. Among these, cellulose derivatives such as a methyl cellulose salt, a carboxymethyl cellulose salt and a hydroxyethyl cellulose salt are preferred, and a sodium or ammonium salt of carboxymethyl cellulose is more preferred. The polyacrylic acid has a molecular weight of preferably from 3,000 to 1,000,000, and more preferably from 5,000 to 500,000.

Among these, polyacrylic acid salts such as sodium polyacrylate is still more preferred. The polyacrylic acid salts are highly effective for a hydrophilization agent of the image formation layer. The content of the polyacrylic acid salts in the image formation layer is from 0.1 to 30% by weight, and preferably from 2 to 15% by weight, whereby a hydrophilic property of the surface revealed by on-press development of the image formation layer is improved. The content less than 0.1% by weight results in less hydrophilization, while the content more than 30% by weight may impair image formation.

The image formation layer can contain an infrared absorbing dye. The content of the infrared absorbing dye in the image formation layer is preferably from 0.001 g/m$^2$ to less than 0.2 g/m$^2$, and more from 0.001 g/m$^2$ to less than 0.05 g/m$^2$ of printing plate material, although it is necessary to consider contamination due to coloring degree of the dye of a printing press on on-press development. It is needless to say that a dye having less coloring degree is preferably used.

Examples of the infrared absorbing dye include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-to-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Compounds described in Japanese Patent O.P.I. Publication Nos. 11-240270, 11-265062, 2000-309174, 2002-49147, 2001-162965, 2002-144750, and 2001-219667 can be preferably used.

A water-soluble surfactant may be contained in the image formation layer in the invention. A silicon atom-containing surfactant and a fluorine atom-containing surfactant can be used. The silicon atom-containing surfactant is especially preferred in that it minimizes printing contamination. The content of the surfactant is preferably from 0.01 to 3.0% by weight, and more preferably from 0.03 to 1.0% by weight based on the total weight of the image formation layer (or the solid content of the coating liquid).

The image formation layer in the invention can contain an acid (phosphoric acid or acetic acid) or an alkali (sodium hydroxide, silicate, or phosphate) to adjust pH.

The coating amount of the image formation layer is from 0.01 to 10 g/m$^2$, preferably from 0.1 to 3 g/m$^2$, and more preferably from 0.2 to 2 g/m$^2$.

(On-Press Development)

In the invention, the image formation layer at portions exposed by for example, infrared laser form image portions laser, and the image formation layer at unexposed portions are removed to form non-image portions. Removal of the image formation layer can be carried out by washing with water, and can be also carried out by supplying dampening solution and/or printing ink to the image formation layer on a press (so-called on-press development).

Removal on a press of the image formation layer at unexposed portions of a printing plate material, which is mounted on the plate cylinder, can be carried out by bringing a dampening roller and an inking roller into contact with the image formation layer while rotating the plate cylinder, and can be also carried out according to various sequences such as those described below or another appropriate sequence. The supplied amount of dampening solution may be adjusted to be greater or smaller than the amount ordinarily supplied in printing, and the adjustment may be carried out stepwise or continuously.

(1) A dampening roller is brought into contact with the image formation layer of a printing plate material, on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

The printing process of the invention comprises the step of forming an image on the printing plate material described above, and supplying a dampening solution containing alcohol in an amount of not more than 5% by weight to the resulting printing plate material.

It is possible in the printing process of the invention to print employing a dampening solution containing alcohol such as IPA in an amount of not more than 5% by weight, since the printing plate material of the invention has high hydrophilicity, and high resistance to stain occurrence at non-image portions. Further, no stain occurrence is produced in printing employing a dampening solution which does not substantially contain alcohol. This means that working circumstances during printing is greatly improved. Herein, "a dampening solution which does not substantially contain alcohol" implies a dampening solution containing no alcohol or a dampening solution containing alcohol in an amount of not more than 1% by weight.

Further, the printing plate material of the invention can be applied to a so-called direct imaging printing press installed with an image formation device for infrared laser exposure, since a specific development is not required. In this case, printing can be carried out employing a dampening solution containing alcohol in an amount of not more than 1% by weight or a dampening solution which does not substantially contain alcohol. This means that the direct imaging printing press can be set at an environment such as an office without an exhauster.

EXAMPLES

The present invention will be detailed employing the following examples. In the examples, "%" is % by weight, unless otherwise particularly specified.

Example 1

[Preparation of Support 1]

Both surfaces of a 175 μm thick biaxially stretched polyester sheet were corona discharged under condition of 8 $W/m^2$·minute. Then, the surface on one side of the resulting sheet was coated with the following subbing layer coating solution (a) to give a first subbing layer with a dry thickness of 0.8 μm, and then coated with the following subbing layer coating solution (b) to give a second subbing layer with a dry thickness of 0.1 μm, while the first subbing layer was corona discharged under condition of 8 $W/m^2$·minute, each layer was dried at 180° C. for 4 minutes (subbing layer A was formed). Successively, the surface on the other side of the resulting sheet was coated with the following subbing layer coating solution (c) to give a third subbing layer with a dry thickness of 0.8 μm, and then coated with the following subbing layer coating solution (d) to give a fourth subbing layer with a dry thickness of 1.0 μm, while the third subbing layer was corona discharged under condition of 8 $W/m^2$·minute, each layer was dried at 180° C. for 4 minutes (subbing layer B was formed. Thus, support 1 having a subbing layer on each surface was prepared. The support 1 had a surface electric resistance at 25° C. and 25% RH of $10^8$ Ω.

| | |
|---|---|
| (Subbing layer coating solution (a)) | |
| Latex of styrene/glycidyl methacrylate/butyl acrylate (60/39/1) copolymer (Tg = 75° C.) | 6.3% (in terms of solid content) |
| Latex of styrene/glycidyl methacrylate/butyl acrylate (20/40/40) copolymer | 1.6% (in terms of solid content) |
| Anionic surfactant S-1 | 0.1% |
| Water | 92.0% |
| (Subbing layer coating solution (b)) | |
| Gelatin | 1.0% |
| Anionic surfactant S-1 | 0.05% |
| Hardener H-1 | 0.02% |
| Matting agent (Silica particles with an average particle diameter of 3.5 μm) | 0.02% |
| Antifungal agent F-1 | 0.01% |
| Water | 98.9% |

S-1

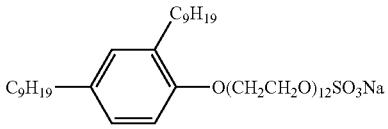

H-1

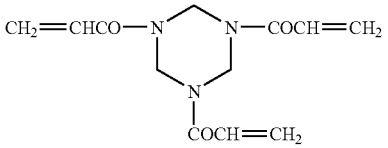

F-1

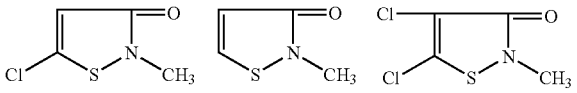

(Component A) (Component B) (Component C)

(Component A): (Component B): (Component C) = 50:46:4 (by mole)

| | |
|---|---|
| (Subbing layer coating solution (c)) | |
| Latex of styrene/glycidyl methacrylate/butyl acrylate (20/40/40) copolymer | 0.4% (in terms of solid content) |
| Latex of styrene/glycidyl methacrylate/butyl acrylate/acetoacetoxyethyl methacrylate (39/40/20/1) copolymer | 7.6% (in terms of solid content) |
| Anionic surfactant S-1 | 0.1% |
| Water | 91.9% |
| (Subbing layer coating solution (d)) | |
| Conductive composition of *Component d-1/Component d-2/ Component d-3 (=66/31/1) | 6.4% |
| Hardener H-2 | 0.7% |
| Anionic surfactant S-1 | 0.07% |
| Silica particles with an average particle diameter of 3.5 μm) | 0.03% |
| Water | 92.8% |

*Component d-1 Copolymer of styrene sulfonic acid/maleic acid (50/50) (Anionic polymer)
*Component d-2 Latex of styrene/glycidyl methacrylate/butyl acrylate (20/40/40) copolymer
*Component d-3 Copolymer of styrene/sodium isoprene sulfonate (80/20) (Polymer surfactant)

H-2

Mixture of three compounds below

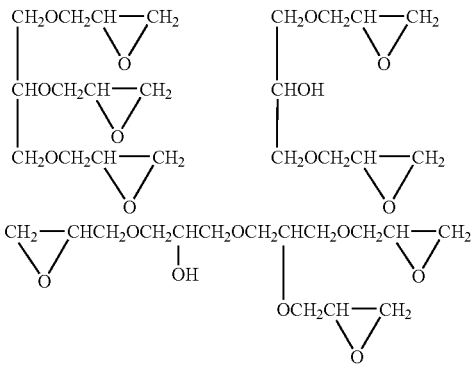

(Measurement of Surface Roughness)

A platinum-rhodium layer with a thickness of 1.5 nm are vacuum-deposited onto a sample surface, and surface roughness is measured under condition of a magnification of 20, employing a non-contact three dimensional surface roughness measuring device RST plus produced by WYKO Co., Ltd., (in which the measurement area is 222.4 μm×299.4 μm). The resulting measurement is subjected to slope correction and to filtering treatment of Median Smoothing. Five portions of each sample are measured and the average of the measurements is defined as surface roughness Ra of the sample.

[Preparation of Printing Plate Material Sample 1]

Materials as shown in Table 1 were sufficiently mixed while stirring at 3000 rpm for 5 minutes, employing a homogenizer, and filtered to obtain hydrophilic layer 1 coating solution with a solid content of 25% by weight.

The hydrophilic layer 1 coating solution was coated on the surface of the subbing layer A side of support 1 with a wire bar to obtain a hydrophilic layer 1 with a dry thickness of 4.0 g/m$^2$, and dried at 100° C. for 3 minutes. The surface roughness Ra of the hydrophilic layer 1 was 0.3 μm, measured according to the method described above. The resulting material, i.e., the composite material of the hydrophilic layer 1 and the support 1 had a transmission density of 1.0.

TABLE 1

| Materials | Amount (parts by weight) |
|---|---|
| Black iron oxide particles ABL-207 (produced by Titan Kogyo K.K., octahedral form, average particle diameter: 0.2 μm, acicular ratio: substantially 1, specific surface area: 6.7 m$^2$/g, Hc: 9.95 kA/m, σs: 85.7 Am$^2$/kg, σr/σs: 0.112) | 12.50 |
| Colloidal silica (alkali type): Snowtex XS (solid content: 20% by weight, produced by Nissan Kagaku Co., Ltd.) | 59.25 |
| Chitosan particle dispersion (produced by Dainichi Seika Co., Ltd., a deacetylation degree of 90% or more, average particle diameter: 2 μm, solid content: 6% by weight | 8.33 |
| Aqueous 10% by weight sodium phosphate.dodecahydrate solution (Reagent produced by Kanto Kagaku Co., Ltd.) | 1.25 |

TABLE 1-continued

| Materials | Amount (parts by weight) |
|---|---|
| Surfactant: Surfinol 465 (produced by Air Products Co., Ltd., 1% by weight aqueous solution) | 2.50 |
| Pure water | 16.17 |

Materials as shown in Table 2 were sufficiently mixed while stirring, and filtered to obtain image formation layer 1 coating solution with a solid content of 10% by weight. The image formation layer 1 coating solution was coated on the resulting hydrophilic layer 1 with a wire bar to obtain an image formation layer 1 with a dry thickness of 0.7 g/m$^2$, dried at 55° C. for 3 minutes, and then subjected to seasoning treatment at 55° C. for 24 hours. Thus, printing plate material sample 1 was prepared. The content of pigment particles (black iron oxide particles) in the printing plate material sample 1 was about 1.9 g/m$^2$.

TABLE 2

| Materials | Amount (parts by weight) |
|---|---|
| Carnauba wax emulsion A118 (the wax having an average particle diameter of 0.3 μm, a softening point of 65° C., a melting point of 80° C., a melt viscosity at 140° C. of 8 cps, and having a solid content of 40% by weight, produced by Gifu Shellac Co., Ltd.) | 17.50 |
| Trehalose powder solution (Treha mp. 97° C., produced by Hayashihara Shoji Co., Ltd.) having a solid content of 10% by weight | 25.00 |
| Aqueous solution of sodium polyacrylate: AQUALIC DL522 (solid content 30%, produced by Nippon Shokubai Co., Ltd.) | 1.67 |
| Pure water | 55.83 |

[Preparation of Printing Plate Material Sample 2]

Materials as shown in Table 3 were sufficiently mixed while stirring, and filtered to obtain image formation layer 2 coating solution with a solid content of 10% by weight. Printing plate material sample 2 was prepared in the same manner as printing plate material sample 1, except that the image formation layer 2 coating solution was used instead of the image formation layer 1 coating solution. The content of pigment particles (black iron oxide particles) in the printing plate material sample 2 was about 1.9 g/m$^2$.

TABLE 3

| Materials | Amount (parts by weight) |
|---|---|
| Acrylonitrile-styrene-alkyl acrylate-methacrylic acid copolymer emulsion: Yodosol GD87B (average particle diameter: 90 nm, Tg: 60° C., solid content: 45% by weight, produced by NIPPON NSC Co., Ltd.) | 15.56 |
| Trehalose powder solution (Treha mp. 97° C., produced by Hayashihara Shoji Co., Ltd.) having a solid content of 10% by weight | 25.00 |
| Aqueous solution of sodium polyacrylate: AQUALIC DL522 (solid content 30%, produced by Nippon Shokubai Co., Ltd.) | 1.67 |
| Pure water | 57.77 |

[Preparation of Printing Plate Material Sample 3]

A microcapsule dispersion solution containing microcapsules encapsulating an oil phase component was prepared according to the following procedure:

Ten g of PVA-205 with a saponification degree of 86.5 to 89.0% (produced by Kuraray Co., Ltd.) was dissolved in 165 g of pure water to prepare an aqueous PVA solution as a water phase component. Next, 10 g of hexamethylene diisocyanate, 2 g of diethylene triamine, and 10 g of polystyrene particles (with an average particle diameter of 1.0 μm) were dissolved in 78 g of d-limonene to prepare an oil phase component. The oil phase component was added to the water phase component with vigorous stirring, and further emulsified at 10,000 rpm in a homogenizer. The resulting emulsion was elevated to 80° C. while weakly stirring, maintained at 80° C. for 60 minutes, and cooled to room temperature. Thus, a microcapsule dispersion solution having a solid content 40% by weight was prepared. The average diameter of the microcapsules was 1.0 μm.

Materials as shown in Table 4 were sufficiently mixed while stirring, and filtered to obtain image formation layer 3 coating solution with a solid content of 10% by weight. Printing plate material sample 3 was prepared in the same manner as printing plate material sample 1, except that the image formation layer 3 coating solution was used instead of the image formation layer 1 coating solution. The content of pigment particles (black iron oxide particles) in the printing plate material sample 3 was about 1.9 g/m$^2$.

TABLE 4

| Materials | Amount (parts by weight) |
|---|---|
| Microcapsule dispersion above | 17.50 |
| Trehalose powder solution (Treha mp. 97° C., produced by Hayashihara Shoji Co., Ltd.) having a solid content of 10% by weight | 25.00 |
| Aqueous solution of sodium polyacrylate: AQUALIC DL522 (solid content 30%, produced by Nippon Shokubai Co., Ltd.) | 1.67 |
| Pure water | 55.83 |

[Preparation of Printing Plate Material Sample 4]

Materials as shown in Table 5 were sufficiently mixed while stirring at 10,000 rpm for 10 minutes, employing a homogenizer, and filtered to obtain hydrophilic layer 2 coating solution with a solid content of 20% by weight. Subsequently, the hydrophilic layer 2 coating solution was coated on the surface of the subbing layer A side of support 1 with a wire bar to obtain a hydrophilic layer 2 with a dry thickness of 3.0 g/m$^2$, and dried at 100° C. for 3 minutes. The surface roughness Ra of the hydrophilic layer 2 was 0.1 μm, measured according to the method described above. The resulting material, i.e., the composite material of the hydrophilic layer 2 and the support 1 had a transmission density of 1.0.

The image formation layer 1 coating solution was coated on the resulting hydrophilic layer 2 with a wire bar to obtain an image formation layer 1 with a dry thickness of 0.7 g/m$^2$, dried at 55° C. for 3 minutes, and then subjected to seasoning treatment at 55° C. for 24 hours. Thus, printing plate material sample 4 was prepared.

TABLE 5

| Materials | Amount (parts by weight) |
|---|---|
| Cu—Fe—Mn type metal oxide black pigment: TM-3550 black aqueous dispersion {prepared by dispersing TM-3550 black powder having a particle diameter of 0.1 μm produced by Dainichi Seika Kogyo Co., Ltd. in water to give a solid content of 40% by weight (including 0.2% by weight of dispersant)} | 10.00 |
| Colloidal silica (alkali type): Snowtex XS (solid content: 20% by weight, produced by Nissan Kagaku Co., Ltd.) | 77.40 |
| Chitosan particle dispersion (produced by Dainichi Seika Co., Ltd., a deacetylation degree of 90% or more, average particle diameter: 2 μm, solid content: 6% by weight | 6.67 |
| Aqueous 10% by weight sodium phosphate.dodecahydrate solution (Reagent produced by Kanto Kagaku Co., Ltd.) | 1.00 |
| Surfactant: Surfinol 465 (produced by Air Products Co., Ltd., 1% by weight aqueous solution) | 2.00 |
| Pure water | 2.93 |

[Preparation of Printing Plate Material Sample 5]

Printing plate material sample 5 was prepared in the same manner as printing plate material sample 4, except that the image formation layer 2 coating solution was used instead of the image formation layer 1 coating solution.

(Evaluation of Printing Plate Material Sample)

<Image Formation Employing Infrared Laser>

Each of the resulting printing plate material samples was mounted on an exposure drum. Image formation was carried out by infrared laser exposure. Exposure was carried out employing an infrared laser (having a wavelength of 830 nm and a beam spot diameter of 18 μm) at an exposure energy of 200 mJ/cm$^2$, at a resolution of 2400 dpi and at a screen line number of 175 to form a solid image, a dot image with an dot area of 1 to 99%, and a line and space image of 2400 dpi. The term, "dpi" herein shows the number of dots per 2.54 cm.

(Printing Method)

Printing was carried out employing a printing press, DAIYA 1F-1 produced by Mitsubishi Jukogyo Co., Ltd., and employing a coated paper, a dampening solution, a 2% by weight solution of Astromark 3 (produced by Nikken Kagaku Kenkyusyo Co., Ltd.), and printing ink (Toyo King Hyecho M Magenta, produced by Toyo Ink Manufacturing Co.).

(Evaluation)

Each of the exposed planographic printing plate material samples was mounted on a plate cylinder of the printing press, and printing was carried out in the same printing sequence as a conventional PS plate. No stain was observed at non-image portions of each sample at the initial printing stage.

Printing was carried out employing each sample, and an image retention property of each sample was evaluated at one thousandth print. The results are shown in Table 6.

TABLE 6

| Sample No. | Image retention property: 2% Dot image | Line and space image | Density in solid image | Remarks |
|---|---|---|---|---|
| 1 | No dots missing | No lack of line and space image | Uniform and not uneven | Inv. |
| 2 | No dots missing | No lack of line and space image | Uniform and not uneven | Inv. |
| 3 | No dots missing | No lack of line and space image | Uniform and not uneven | Inv. |
| 4 | No dot image formed | No line and space image formed | Uneven | Comp. |
| 5 | No dot image formed | No line and space image formed | Uneven | Comp. |

Inv.: Invention,
Comp.: Comparative

As is apparent from Table 6, pigment contained in the hydrophilic layer of the inventive printing plate material samples has a high roughness formation capability as compared with that in the inventive printing plate material samples, and the inventive printing plate material samples provide excellent image retention property.

Example 2

[Preparation of Support 2]

A 0.24 mm thick aluminum plate (1050, H16) was immersed in an aqueous 1% by weight sodium hydroxide solution at 50° C. to give an aluminum dissolution amount of 2 g/m$^2$, washed with water, immersed in an aqueous 0.1% by weight hydrochloric acid solution at 25° C. for 30 seconds to neutralize, and then washed with water.

Subsequently, the aluminum plate was subjected to an electrolytic surface-roughening treatment in an electrolytic solution containing 10 g/liter of hydrochloric acid and 0.5 g/liter of aluminum at a peak current density of 50 A/dm$^2$ employing an alternating current with a sine waveform, in which the distance between the plate surface and the electrode was 10 mm. The electrolytic surface-roughening treatment was divided into 10 treatments, in which the quantity of electricity used in one treatment (at a positive polarity) was 60 C/dm$^2$, and the total quantity of electricity used (at a positive polarity) was 600 C/dm$^2$. Standby time of 4 seconds, during which no surface-roughening treatment was carried out, was provided after each of the separate electrolytic surface-roughening treatments.

Subsequently, the resulting aluminum plate was immersed in an aqueous 1% by weight sodium hydroxide solution at 50° C. and etched to give an aluminum etching amount (including smut produced on the surface) of 2 g/m$^2$, washed with water, neutralized in an aqueous 10% by weight sulfuric acid solution at 25° C. for 10 seconds, and washed with water. Subsequently, the aluminum plate was subjected to anodizing treatment in an aqueous 20% by weight sulfuric acid solution at a constant voltage of 20 V, in which a quantity of electricity of 150 C/dm$^2$ was supplied, and washed with water.

The washed surface of the plate was squeegeed, and the plate was immersed in an aqueous 0.5% by weight disodium hydrogen phosphate solution at 70° C. for 30 seconds, washed with water, and dried at 80° C. for 5 minutes. Thus, the support 2 was obtained.

The surface roughness Ra of the support 2 was 0.7 μm.

[Preparation of Printing Plate Material Sample 6]

Materials as shown in Table 7 were sufficiently mixed while stirring at 3000 rpm for 5 minutes, employing a homogenizer, and filtered to obtain hydrophilic layer 3 coating solution with a solid content of 30% by weight. The hydrophilic layer 3 coating solution was coated on support 2 with a wire bar to obtain a hydrophilic layer 1 with a dry thickness of 4.0 g/m$^2$, and dried at 100° C. for 3 minutes. The surface roughness Ra of the hydrophilic layer 3 was 0.7 μm, measured according to the method described above.

TABLE 7

| Materials | Amount (parts by weight) |
|---|---|
| Black iron oxide particles ABL-207 (produced by Titan Kogyo K.K., octahedral form, average particle diameter: 0.2 μm, acicular ratio: substantially 1, specific surface area: 6.7 m$^2$/g, Hc: 9.95 kA/m, σs: 85.7 Am$^2$/kg, σr/σs: 0.112) | 13.50 |
| Porous metal oxide particles JC70 (Porous aluminosilicate particles, average particle diameter: 0.2 μm, produced by Mizusawa Kagaku Co., Ltd.) | 3.00 |
| Colloidal silica (alkali type): Snowtex XS (solid content: 20% by weight, produced by Nissan Kagaku Co., Ltd.) | 63.75 |
| Chitosan particle dispersion (produced by Dainichi Seika Co., Ltd., a deacetylation degree of 90% or more, average particle diameter: 2 μm, solid content: 6% by weight | 10.00 |
| Aqueous 10% by weight sodium phosphate.dodecahydrate solution (Reagent produced by Kanto Kagaku Co., Ltd.) | 1.50 |
| Pure water | 8.25 |

Subsequently, the image formation layer 1 coating solution prepared in Example 1 was coated on the resulting hydrophilic layer 3 with a wire bar to obtain an image formation layer 1 with a dry thickness of 0.7 g/m$^2$, dried at 55° C. for 3 minutes, and then subjected to seasoning treatment at 55° C. for 24 hours. Thus, printing plate material sample 6 was prepared. The content of pigment particles (black iron oxide particles) in the printing plate material sample 6 was about 1.8 g/m$^2$.

[Preparation of Printing Plate Material Sample 7]

Materials as shown in Table 8 were sufficiently mixed while stirring, and filtered to obtain image formation layer 4 coating solution with a solid content of 10% by weight. Printing plate material sample 7 was prepared in the same manner as printing plate material sample 6, except that the image formation layer 4 coating solution was used instead of the image formation layer 1 coating solution. The content of pigment particles (black iron oxide particles) in the printing plate material sample 7 was about 1.8 g/m$^2$.

TABLE 8

| Materials | Amount (parts by weight) |
|---|---|
| Carnauba wax emulsion A118 (the wax having an average particle diameter of 0.3 μm, a softening point of 65° C., a melting point of 80° C., a melt viscosity at 140° C. of 8 cps, and having a solid content of 40% by weight, produced by Gifu Shellac Co., Ltd.) | 15.56 |
| Trehalose powder solution (Treha mp. 97° C., produced by Hayashihara Shoji Co., Ltd.) having a | 23.50 |

TABLE 8-continued

| Materials | Amount (parts by weight) |
|---|---|
| solid content of 10% by weight | |
| Aqueous solution of sodium polyacrylate: AQUALIC DL522 (solid content 30%, produced by Nippon Shokubai Co., Ltd.) | 1.67 |
| Infrared absorbing dye ADS830WS (1% by weight aqueous solution, produced by American Dye Source Co., Ltd.) | 15.00 |
| Pure water | 42.33 |

[Preparation of Printing Plate Material Sample 8]

Materials as shown in Table 9 were sufficiently mixed while stirring at 10,000 rpm for ten minutes, and filtered to obtain hydrophilic layer 4 coating solution with a solid content of 20% by weight. Printing plate material sample 8 was prepared in the same manner as printing plate material sample 6, except that the hydrophilic layer 4 coating solution was used instead of the hydrophilic layer 3 coating solution to give a hydrophilic layer 4 with a dry thickness of 3.0 g/m$^2$.

TABLE 9

| Materials | Amount (parts by weight) |
|---|---|
| Cu—Fe—Mn type metal oxide black pigment: TM-3550 black aqueous dispersion {prepared by dispersing TM-3550 black powder having a particle diameter of 0.1 μm produced by Dainichi Seika Kogyo Co., Ltd. in water to give a solid content of 40% by weight (including 0.2% by weight of dispersant)} | 5.00 |
| Colloidal silica (alkali type): Snowtex S (solid 30% by weight, produced by Nissan Kagaku Co., Ltd.) | 17.73 |
| Necklace shaped colloidal silica (alkali type): Snowtex PSM (solid 20% by weight, produced by Nissan Kagaku Co., Ltd.) | 39.90 |
| Porous metal oxide particles Silton AMT08 (porous aluminosilicate particles having an average particle diameter of 0.6 μm, produced by Mizusawa Kagaku Co., Ltd.) | 2.00 |
| Porous metal oxide particles JC40 (porous aluminosilicate particles having an average particle diameter of 4 μm, produced by Mizusawa Kagaku Co., Ltd.) | 2.00 |
| Layer structural clay mineral particles: Montmorillonite Mineral Colloid MO gel prepared by vigorously stirring montmorillonite Mineral Colloid MO; gel produced by Southern Clay Products Co., Ltd. (average particle diameter: 0.1 μm) in water in a homogenizer to give a solid content of 5% by weight | 8.00 |
| Aqueous 4% by weight sodium carboxymethyl cellulose solution (Reagent produced by Kanto Kagaku Co., Ltd.) | 5.00 |
| Aqueous 10% by weight sodium phosphate.dodecahydrate solution (Reagent produced by Kanto Kagaku Co., Ltd. | 1.00 |
| Pure water | 19.37 |

[Preparation of Printing Plate Material Sample 9]

Materials as shown in Table 10 were sufficiently mixed while stirring at 10,000 rpm for ten minutes, and filtered to obtain hydrophilic layer 5 coating solution with a solid content of 20% by weight. Printing plate material sample 9 was prepared in the same manner as printing plate material sample 8, except that the hydrophilic layer 5 coating solution was used instead of the hydrophilic layer 4 coating solution.

TABLE 10

| Materials | Amount (parts by weight) |
|---|---|
| Cu—Fe—Mn type metal oxide black pigment: TM-3550 black aqueous dispersion {prepared by dispersing TM-3550 black powder having a particle diameter of 0.1 μm produced by Dainichi Seika Kogyo Co., Ltd. in water to give a solid content of 40% by weight (including 0.2% by weight of dispersant)} | 10.00 |
| Colloidal silica (alkali type): Snowtex S (solid 30% by weight, produced by Nissan Kagaku Co., Ltd.) | 15.07 |
| Necklace shaped colloidal silica (alkali type): Snowtex PSM (solid 20% by weight, produced by Nissan Kagaku Co., Ltd.) | 33.90 |
| Porous metal oxide particles Silton AMT08 (porous aluminosilicate particles having an average particle diameter of 0.6 μm, produced by Mizusawa Kagaku Co., Ltd.) | 2.00 |
| Porous metal oxide particles JC40 (porous aluminosilicate particles having an average particle diameter of 4 μm, produced by Mizusawa Kagaku Co., Ltd.) | 2.00 |
| Layer structural clay mineral particles: Montmorillonite Mineral Colloid MO gel prepared by vigorously stirring montmorillonite Mineral Colloid MO; gel produced by Southern Clay Products Co., Ltd. (average particle diameter: 0.1 μm) in water in a homogenizer to give a solid content of 5% by weight | 8.00 |
| Aqueous 4% by weight sodium carboxymethyl cellulose solution (Reagent produced by Kanto Kagaku Co., Ltd.) | 5.00 |
| Aqueous 10% by weight sodium phosphate.dodecahydrate solution (Reagent produced by Kanto Kagaku Co., Ltd. | 1.00 |
| Pure water | 23.03 |

[Preparation of Printing Plate Material Sample 10]

Materials as shown in Table 11 were mixed in such order as described in Table 1, and stirred at room temperature for one hour to prepare a sol-gel solution.

TABLE 11

| Materials | Amount (parts by weight) |
|---|---|
| Tetramethoxysilane | 20.00 |
| Ethanol | 40.00 |
| Pure water | 39.98 |
| Nitric acid | 0.02 |

Materials as shown in Table 12 were mixed, and dispersed for 30 minutes in a sand grinder having zirconia beads with a bead diameter of 0.05 mm. After removing the beads, the mixture was filtered to obtain a hydrophilic layer 6 coating solution.

TABLE 12

| Materials | Amount (parts by weight) |
|---|---|
| Sol-gel solution described above | 15.00 |
| Colloidal silica (neutral type): Snowtex C (solid content 20% by weight, produced by Nissan Kagaku Co., Ltd.) | 35.00 |
| Polyvinyl alcohol PVA117 (10% by weight aqueous solution, produced by Kuraray Co., Ltd.) | 20.00 |
| Alumina particles with an average particle diameter of 0.05 μm | 6.00 |

TABLE 12-continued

| Materials | Amount (parts by weight) |
|---|---|
| Carbon black aqueous dispersion SD9020 (solid content 30% by weight, produced by Dainippon Ink Co., Ltd.) | 6.67 |
| Pure water | 17.33 |

Printing plate material sample 10 was prepared in the same manner as printing plate material sample 8, except that the hydrophilic layer 6 coating solution was used instead of the hydrophilic layer 4 coating solution.

[Evaluation of Printing Plate Material Samples]

(Image Formation Employing Infrared Laser)

Each of the resulting printing plate samples was wound around an exposure drum and imagewise exposed. Exposure was carried out employing an infrared laser (having a wavelength of 830 nm and a beam spot diameter of 18 μm) at a resolution of 2400 dpi and at a screen line number of 175 to form a solid image, a dot image with an dot area of 1 to 99%, and a line and space image of 2400 dpi. In the exposure, the exposure energy was varied from 100 to 400 mJ/cm$^2$ at an interval of 25 mJ/cm$^2$. The term, "dpi" shows the number of dots per 2.54 cm.

(Printing Method)

Printing was carried out employing a printing press, DAIYA 1F-1 produced by Mitsubishi Jukogyo Co., Ltd. and employing a coated paper and printing ink (Toyo King Hyunity M Magenta, produced by Toyo Ink Manufacturing Co.). In printing, three dampening solutions, a 2% by weight solution of Astromark 3 (produced by Nikken Kagaku Kenkyusyo Co., Ltd.), a solution in which IPA was added in an amount of 3% by weight to the 2% by weight solution of Astromark 3, and a solution in which IPA was added in an amount of 6% by weight to the 2% by weight solution of Astromark 3, were employed.

(Evaluation)

Each of the exposed planographic printing plate material samples was mounted on a plate cylinder of the printing press, and printing was carried out in the same printing sequence as a conventional PS plate.

(Sensitivity)

Employing the solution in which IPA was added in an amount of 6% by weight to the 2% by weight solution of Astromark 3, printing was carried out to obtain 1000 copies. The lowest exposure energy (mJ/cm$^2$) at which an image with a 2% dot area is reproduced in the 1000$^{th}$ copy was defined as sensitivity.

(Initial Printability)

Employing the three dampening solutions as described above and the printing plate material sample exposed at the exposure energy represented by sensitivity obtained, printing was carried out. The number of paper sheets printed from when printing started till when good image (with a solid image with a density of 1.5 or more and without stain) was obtained was counted and evaluated as a measure of initial printability. When a stain remains (a measure of stain described below is not less than 0.1) at one hundredth print, the initial printability was determined as >100.

(Stain)

Employing the three dampening solutions as described above (and the printing plate material sample exposed at the exposure energy represented by sensitivity obtained), printing was carried out. The difference between a density of the original coated paper and that of the non-image portions of the 300$^{th}$ copy was evaluated as a measure of stain.

(Printing Durability 1)

Printing was carried out employing a dampening solution containing no IPA, and coated paper sheet to obtain 20,000 copies. The printing plate material sample exposed at the exposure energy represented by sensitivity obtained above was used for printing. The number of paper sheets printed from when printing started till when elimination of dots at the 5% dot image portion was observed was counted and evaluated as printing durability 1. The more the number, the higher printing durability is.

(Printing Durability 2)

Accelerated printing durability test was carried out. Printing was carried out employing a dampening solution containing no IPA, and wood-free paper sheet (SHIRAOI) to obtain 10,000 copies, in which a 50 μm thick underlay sheet was provided between the plate cylinder and the printing plate material sample to give an increased printing pressure. The printing plate material sample exposed at the exposure energy represented by sensitivity obtained above was used for printing. The number of paper sheets printed from when printing started till when elimination of dots at the 5% dot image portion was observed was counted and evaluated as printing durability 2. The more the number, the higher printing durability is.

The results are shown in Table 13.

TABLE 13

| | | Dampening solution | | | | | | | | |
|---|---|---|---|---|---|---|---|---|---|---|
| | | Dampening solution containing no IPA | | Dampening solution containing IPA in an amount of 3% by weight | | Dampening solution containing IPA in an amount of 6% by weight | | | | |
| Sample No. | Sensitivity (mJ/cm$^2$) | Initial printability | Stain | Initial printability | Stain | Initial printability | Stain | Printing durability 1 | Printing durability 2 | Remarks |
| 6 | 200 | 10 | 0 | 10 | 0 | 10 | 0 | >20000 | >10000 | Inv. |
| 7 | 150 | 10 | 0 | 10 | 0 | 10 | 0 | >20000 | >10000 | Inv. |
| 8 | 300 | 10 | 0 | 10 | 0 | 10 | 0 | >20000 | 8000 | Comp. |

TABLE 13-continued

| | | Dampening solution | | | | | | | | |
|---|---|---|---|---|---|---|---|---|---|---|
| | | Dampening solution containing no IPA | | Dampening solution containing IPA in an amount of 3% by weight | | Dampening solution containing IPA in an amount of 6% by weight | | | | |
| Sample No. | Sensitivity (mJ/cm$^2$) | Initial printability | Stain | Initial printability | Stain | Initial printability | Stain | Printing durability 1 | Printing durability 2 | Remarks |
| 9 | 225 | 10 | 0 | 10 | 0 | 10 | 0 | 15000 | 4000 | Comp. |
| 10 | 300 | >100 | 0.15 | 80 | 0.05 | 50 | 0.02 | 3000 | 500 | Comp. |

Inv.: Invention,
Comp.: Comparative

As is apparent from Table 13, the inventive printing plate material samples have high sensitivity, provide good initial printability irrespective of composition of the dampening solutions, and produce no stain even when the IPA free dampening solution is employed. Further, the inventive printing plate material samples exhibit good printing durability even under severe printing conditions.

What is claimed is:

1. A printing plate material, comprising a support having a hydrophilic layer provided thereon, wherein said hydrophilic layer contains pigment particles capable of converting light to heat, said pigment particles are octahedral black iron oxide particles that have an average particle diameter ranging from 0.15 μm to less than 1.0 μm, and said hydrophilic layer has a surface roughness Ra ranging from 0.2 μm to less than 1.5 μm.

2. The printing plate material of claim 1, wherein the content of the pigment particles in the hydrophilic layer ranges from 0.5 g/m$^2$ to less than 5 g/m$^2$.

3. The printing plate material of claim 1, wherein an image formation layer, containing a hydrophobe precursor, is provided on the hydrophilic layer.

4. The printing plate material of claim 3, wherein the hydrophobe precursor is thermoplastic hydrophobic particles or microcapsules encapsulating a hydrophobic compound.

5. The printing plate material of claim 4, wherein the hydrophobe precursor is thermoplastic hydrophobic particles.

6. The printing plate material of claim 5, wherein the thermoplastic hydrophobic particles are particles formed from wax selected from the group consisting of paraffin wax, polyolefin wax, microcrystalline wax, fatty acid esters, and higher fatty acids.

7. The printing plate material of claim 3, wherein the image formation layer further contains a salt of polyacrylic acid.

8. The printing plate material of claim 3, wherein the image formation layer contains an infrared absorbing dye.

9. A printing process comprising the step of: imagewise exposing the printing plate material of any one of claims 1 through 8; and supplying a dampening solution containing alcohol in an amount of not more than 5% by weight to the resulting printing plate material.

10. The printing process of claim 9, wherein the imagewise exposing is carried out employing an infrared laser.

11. The printing process of claim 9, wherein the dampening solution does not substantially contain alcohols.

12. The printing process of claim 9, wherein the imagewise exposing is carried out on a printing press.

* * * * *